United States Patent [19]

Corradi et al.

[11] 4,056,410

[45] Nov. 1, 1977

[54] PROCESS FOR PREPARING ACICULAR IRON POWDERS CONTAINING TITANIUM AND TIN, AND THE RESULTING POWDERS WHEN SO PREPARED

[75] Inventors: Ariello Rolando Corradi, Romentino (Novara); Giuliano Fagherazzi, Novara, both of Italy

[73] Assignee: Montedison, S.p.A., Milan, Italy

[21] Appl. No.: 635,985

[22] Filed: Nov. 28, 1975

[30] Foreign Application Priority Data

Nov. 29, 1974 Italy ..... 30014/74

[51] Int. Cl.[2] ..... H01F 1/02

[52] U.S. Cl. ..... 148/105; 75/.5 BA; 252/62.56

[58] Field of Search ..... 75/.5 AA, .5 BA; 148/105, 108; 252/62.55, 62.56, 62.59

[56] References Cited

U.S. PATENT DOCUMENTS

| | | | |
|---|---|---|---|
| 2,651,105 | 9/1953 | Neel | 75/.5 AA |
| 3,598,568 | 8/1971 | Klomp et al. | 75/.5 AA |
| 3,607,220 | 9/1971 | van der Giessen et al. | 75/.5 AA |
| 3,634,063 | 1/1972 | Hwane | 148/105 |
| 3,669,643 | 6/1972 | Bagley et al. | 75/.5 AA |
| 3,702,270 | 11/1972 | Kawasaki et al. | 75/.5 AA |

FOREIGN PATENT DOCUMENTS

| | | | |
|---|---|---|---|
| 1,265,768 | 3/1972 | United Kingdom | 75/.5 |

OTHER PUBLICATIONS van der Giessen, et al.; *Iron Pow. By Pseudomorphic Red.*, in *IEEE Trans.*, Sept. 1969, pp. 317–320.

*Primary Examiner*—Walter R. Satterfield

*Attorney, Agent, or Firm*—Stevens, Davis, Miller & Mosher

[57] ABSTRACT

A process is disclosed for preparing metallic powders based on iron and suitable for magnetic recording, starting from acicular particles of an iron compound selected from the class consisting of $\alpha$-$Fe_2O_3$, $\alpha$-FeOOH and $Fe_3O_4$, by reduction with a gas containing more than 50% by volume of hydrogen, characterized in that the particles of the iron compound are treated with titanium, in the form of $TiO(OH)_2$ or $TiO_2$, and with tin, in the form of $Sn(OH)_2$ or $SnO(OH)_2$; after which they are subjected to at least a heat treatment in air at 400°–550° C; and finally to a reducing treatment at 340°–420° C. The titanium is employed in an amount of 0.5–1% by weight, calculated as $TiO_2$, and the tin in an amount of 3–6% by weight, based on pure iron. Prior to reduction, the particles of the iron compound may be treated not only with titanium and tin, but also with cobalt and/or silica, the cobalt in an amount not exceeding 6% by weight with respect to pure iron and the silica in an amount not exceeding 5% by weight with respect to pure iron. The metallic powders based on iron suitable for magnetic recording, and containing 0.5–1% by weight, with respect to pure iron, of titanium calculated as $TiO_2$, and 3–6% by weight of Sn, with respect to pure iron, and having an average particle length ranging from 0.3 to 1$\mu$ and an average particle diameter ranging from 0.1 to 0.4 $\mu$; with or without a maximum of not more than 5% by weight of $SiO_2$ with respect to pure iron and not more than 6% by weight of Co with respect to pure iron, are also disclosed.

9 Claims, No Drawings

PROCESS FOR PREPARING ACICULAR IRON POWDERS CONTAINING TITANIUM AND TIN, AND THE RESULTING POWDERS WHEN SO PREPARED

This invention relates to new iron-based metallic powders suitable for utilization in connection with magnetic recording devices (tapes, discs, cylinders, etc.), and to a process for preparing same.

As is well known, powders of metal oxides, such as $\gamma$-$Fe_2O_3$, either pure or mixed with cobalt, and $CrO_2$, thanks to their granulometric and magnetic characteristics (coercivity $H_c$ = 240–450 Oe, saturation magnetization at room temperature for mass unit $\sigma_s$ = 70–92 emu/g), are used for manufacturing audio and video magnetic tapes, for electronic processors, and for other purposes.

At present there is a growing interest in some metallic powders having magnetic characteristics far higher than those of the above-mentioned oxides and consisting of metal alloys based on iron or cobalt. The high magnetic characteristics of these powders depend not only on their chemical composition but also on the shape anisotropy of the individual particles. For this reason the particles exhibit a high length/diameter ratio in the submicron range.

Such powders may be prepared by pseudomorphic reduction with hydrogen of acicular particles of oxides or hydroxides of their respective metals. A conversion is defined as "pseudo-morphic" when the morphology of the starting material particles is imparted to the reaction product particles, although such morphology is not its "natural" morphology. The process in question is considerably complicated in practice: in fact, when it is operated at low temperatures, the rate of reduction is extremely low, while when it is operated at higher temperatures, for example at about 340°–420° C, it is very difficult to prevent sintering phenomena among the particles and "collapse" of same, with consequent loss of their individuality and shape.

Of course such phenomena make the microcrystalline and magnetic characteristics of the product worse, as well as its tendency to be inglobed into or included within the organic matrix during the preparation of magnetic tapes or of other magnetic recording devices.

With a view to increasing the saturation magnetization $\sigma_s$ of the above-mentioned alloys, that is to improving their intrinsic magnetocrystalline characteristics, the procedure generally followed consists in raising the cobalt content; but it is known that higher cobalt percentages, besides affecting the product cost, accelerate the ageing and oxidation phenomena, i.e., they promote the ultimate deterioration of the magnetic characteristics.

Another drawback of the methods of the art consists in that the product obtained always exhibits a marked tendency towards spontaneous re-oxidation and, at the limit, to pyrophoricity. As a consequence, it becomes necessary to carry out a passivating treatment after the reduction in order to protect the particles from both oxidation and ageing phenomena.

It is thus an object of the present invention to provide a process that permits one to obtain iron-based metallic powders suited for magnetic recording purposes and characterized by a high value of the length/diameter ratio (and, consequently, by high values of coercivity $H_c$), by good intrinsic magnetocrystalline characteristics, and by such shape and dimensions as to be easily inglobed into the organic matrix during the preparation of the magnetic tapes or the like.

Another object is that of providing a process which, although not including any final passivating treatment, permits one to obtain a product considerably resistant to spontaneous re-oxidation.

A further object is that of providing a process that permits one to obtain iron-based metallic powders which, although containing extremely low and, in some cases, no cobalt, nevertheless exhibit high values of saturation magnetization $\sigma_s$.

Still another object is that of enabling one to pseudomorphically reduce the acicular iron oxides and hydroxides at rather high temperatures (and therefore with good reduction kinetics) without encountering sintering and collapsing phenomena of the particles.

It has now, surprisingly, been found that the aforesaid results can be achieved if the iron oxides and hydroxides, before being subjected to reduction, are suitably provided with added titanium, in the form of $TiO(OH)_2$ or $TiO_2$, and with added tin, in the form of $Sn(OH)_2$ or $SnO(OH)_2$. It has also been found that these two additives have a reciprocally synergistic effect in attaining the aforesaid results.

Furthermore it has been found that if the iron oxides and hydroxides, prior to reduction, are suitably provided also with added cobalt and/or silica, the presence of tin and titanium at the same time brings about a synergistic effect with respect to the effect that cobalt and/or silica would have if employed individually.

Thus it is the ultimate object of this invention to provide a process for preparing metallic powders based on iron, suitable for use in magnetic recording, and starting from acicular particles of a compound selected from the class consisting of $\alpha$-$Fe_2O_3$, $\alpha$-FeOOH and $Fe_3O_4$, by reduction with a gas containing more than 50% by volume of hydrogen, characterized in that the particles of the iron compound (1) are associated with added titanium, in the form of $TiO(OH)_2$ or of $TiO_2$, and with added tin in the form of $Sn(OH)_2$ or $SnO(OH)_2$; (2) are subjected to at least one heat treatment in air at 400°–550° C; and, finally, (3) are reduced at 340°–420° C.

When practising the process of the present invention it is preferable to start from acicular $\alpha$-$Fe_2O_3$ or $\alpha$-FeOOH that can be prepared according to well known techniques, for example by precipitation from solutions of $FeSO_4 \cdot 7\ H_2O$.

The particles of the starting $\alpha$-$Fe_2O_3$, $\alpha$-FeOOH or $Fe_3O_4$ preferably have a length varying from 0.5 to 1$\mu$ and a diameter ranging from 0.05 to 0.2$\mu$.

The addition of tin to the starting iron compound is carried out in the amount of 3–6% by weight with respect to the pure iron, and preferably in the amount of 4–5% by weight.

Best results are attained by carrying out the addition as follows:

preparing a suspension of $\alpha$-$Fe_2O_3$, $\alpha$-FeOOH or $Fe_3O_4$ in water;

adding an acid solution of any tin salt, for example $SnCl_2 \cdot 2H_2O$ or $SnSO_4$, in an amount varying according to the percentage of Sn to be introduced;

bringing the pH to a value between 3 and 5 by means of $NH_4OH$ or NaOH, so as to cause $Sn(OH)_2$ or $SnO(OH)_2$ to precipitate onto the solid particles;

keeping the suspension for about 20–40 minutes at a temperature ranging from room temperature to 60° C; and filtering, washing and drying (for example at 80°–120° C) the mass so obtained.

Titanium is added to the starting iron compound in an amount of 0.5 – 1% by weight calculated as $TiO_2$ with respect to pure iron.

The addition of titanium is carried out, for instance, in the following way:

preparing a suspension of $\alpha$-$Fe_2O_3$, $\alpha$-FeOOH or $Fe_3O_4$ in ethyl alcohol;

adding a $TiCl_4$ alcoholic solution in an amount varying according to the percentage of Ti to be introduced;

adding water in the amount necessary to cause $TiO(OH)_2$ to precipitate onto the solid particles;

keeping the suspension for about 20–40 minutes at a temperature between room temperature and 60° C; and filtering, washing and drying (for instance at 80°–120° C) the mass thus obtained.

Another method of introducing the titanium is the following:

preparing a fluid mixture of $\alpha$-$Fe_2O_3$, $\alpha$-FeOOH or $Fe_3O_4$ in alcohol;

adding, under stirring, a titanium organic salt, such as for example titanium tetraisopropylate—$Ti[(CH_3)_2CHO]_4$—in an alcoholic solution;

keeping the mass for about 20–40 minutes at a temperature ranging from room temperature to 60° C; and drying (for example at 80°–120° C) the obtained mass.

Better results are obtained in the successive reduction if the additions are carried out in the following order: first the tin and then the titanium.

In some cases it may be of advantage to also add cobalt and/or silica, besides tin and titanium, to the iron compound prior to reduction.

Cobalt is optionally added in an amount not exceeding 6% by weight with respect to pure iron, preferably in an amount of 4–5% by weight.

Best results with cobalt have been achieved by operating as follows:

preparing a fluid paste of $\alpha$-$Fe_2O_3$, $\alpha$-FeOOH or $Fe_3O_4$ in water;

adding a cobalt acetate solution in an amount varying according to the percentage of Co to be introduced;

causing the suspension to become pasty through heating up to 50°–80° C and intense stirring; and drying the mass at 80°–120° C.

Silica is optionally added in an amount not exceeding 5% by weight with respect to pure iron, preferably in an amount of 2–3% by weight.

Preferably the silica is added in the following way:

preparing a suspension of $\alpha$-$Fe_2O_3$, $\alpha$-FeOOH or $Fe_3O_4$ in water;

adding a sodium silicate solution, $Na_2SiO_3$, in an amount varying according to the percentage of $SiO_2$ to be introduced;

bringing the pH value to 6 or less, by adding, for example, HCl or $HNO_3$, so as to cause a silica gel to precipitate onto the solid particles;

keeping the suspension for about 20–40 minutes at a temperature between room temperature and 60° C; and filtering, washing and drying (for instance at 80°–120° C) the mass so obtained.

The addition of silica should preferably take place after the optional cobalt addition and after the tin addition, but before the titanium addition.

In some cases, and if so desired, the iron compound may be supplemented also with small amounts of nickel (for example 1–3% by weight with respect to iron), which should be preferably added through imbibition with nickel acetate (i.e., according to methods similar to those followed for cobalt).

Before reduction the iron compound is subjected to at least one heat treatment in air at a temperature between 400° and 550° C, for a time-period generally between 1 and 3 hours, so as to cause a reaction between additive and substratum on the surface of the particles. When the starting iron compound is $\alpha$-FeOOH, this heat treatment serves also to cause the following dehydration reaction to occur:

$$2\alpha\text{-FeOOH} \rightarrow \alpha\text{-}Fe_2O_3 + H_2O.$$

Theoretically, a heat treatment may be conducted after each addition. In practice, however, it is preferable to carry out only one heat treatment after the last addition. If desired, however, the heat treatment can be combined in one single step with the drying that takes place at the conclusion of each addition.

If cobalt is employed, then the heat treatment should be suitably conducted just after the cobalt has been incorporated.

The iron compound, once added and heat-treated, is subjected to reduction at 340°–420° C, preferably at 360°–400° C, in a reactor of any known type, but preferably in a fluid bed reactor. Pure hydrogen, or a gaseous mixture containing at least 50% by volume of hydrogen, for example hydrogen/nitrogen, hydrogen/argon, hydrogen/helium mixtures, or water gas ($CO + H_2 + CO_2$) enriched with hydrogen, may be employed as reducing gas. Reduction times range from 3 to 8 hours.

The contemporaneous presence of titanium, in the form of $TiO(OH)_2$ or $TiO_2$, and of tin, in the form of $Sn(OH)_2$ or $SnO(OH)_2$, prevents particles sintering and collapse phenomena from occurring during the reducing reaction, and consequently at the conclusion of the process particles having the following characteristics are obtained:

average length: 0.3 – 1.0$\mu$ average diameter: 0.1 – 0.4$\mu$ length/diameter average ratio: from 3:1 to 4:1 coercivity $H_c$: not lower than 700 Oe saturation magnetization at room temperature $\sigma_s$: not lower than 150 emu/g residual magnetization $\sigma_R$: not lower than 70 emu/g.

Magnetic measurements have been carried out by means of a vibrating-sample magnetometer of the FONER type, and $\sigma_s$ has been measured with a magnetic field of 10 KOe. The value of $\sigma_R$ (residual magnetic induction per unit of mass) is determined when the magnetic field is null.

The new iron-based metallic powders prepared according to the present invention have a Ti content equal to 0.5–1%, calculated as $TiO_2$, and a Sn content equal to 3–6%. The Co percentage is lower than that usually employed or even null (and in any case not higher than 6%). Si, if present, does not exceed 5% calculated as $SiO_2$. Ni, if any, does not exceed 3%. All abovesaid percentages are by weight and are calculated with respect to pure iron.

The low or null cobalt content, besides limiting the production costs, causes the products obtained to exhibit a higher magnetic stability in the long run.

The obtained products are absolutely free from reoxidation and pyrophoricity phenomena, and accordingly it is generally not necessary to carry out any passivating treatment after the reduction.

The sizes of the particles are particularly suited to the inglobing into the organic matrix during the preparation of magnetic tapes or other magnetic recording devices.

All the aforesaid advantages are achieved by a process of great simplicity, both as regards the operating procedures as well as the apparatus used during the steps of introducing the various additives as well as in the reduction step.

The following examples are given in order still better to illustrate further advantages and other features of the present industrial invention:

EXAMPLE 1

6.3 g of $\alpha$-FeOOH (obtained by precipitation from a $FeSO_4 . 7H_2O$ solution), whose acicular particles had an average length of 0.8$\mu$ and an average diameter of 0.1$\mu$, were imbibed with 5.6 cc of a 0.2 M Co $(CH_3COO)_2$ solution and with 25 cc of $H_2O$, thus forming a fluid paste. Such paste was brought to 80° C, under intense stirring, until water evaporated so as to obtain a pasty mass that was successively placed into a furnace at 100° C, kept therein for 2 hours, and then treated at 495° C in air for 2 hours. The iron compound contained now 4.8% by weight of Co with respect to pure iron.

0.5 g of the so-treated iron compound were reduced for 5 hours and 30 minutes with $H_2$ at 351° C.

The resulting product was in the form of particles having an average length of 0.25$\mu$ and an average diameter of 0.14$\mu$, being Hc = 440 Oe, $\sigma_s$ = 165 emu/g, $\sigma_R/\sigma_S$ = 0.55.

Such product, after having been kept for 30 days in the air exhibited a reduction of the $\sigma_s$ value equal to 19%.

EXAMPLE 2

5.77 g of the same $\alpha$-FeOOH of Example 1 were suspended in $H_2O$ and 15 cc of a $SnCl_2 . 2H_2O$ solution acidified by HCl (0.1 M solution) were admixed therewith. The pH value was brought to 4.5 and stirring was conducted for 30 minutes at 45° C. It was filtered and washed by decantation until the filtrate reacted no longer positively to Cl−with $AgNO_3$. It was dried at 100° C and then subjected to heat treatment in air for 2 hours at 510° C.

Such sample exhibited on analysis a Sn content of 4.83% with respect to pure iron.

0.5 g of the so-treated iron compound, reduced for 28 hours at 350° C with $H_2$, yielded a product in the form of particles having an average length of 0.5$\mu$ and an average diameter of 0.14 $\mu$ and exhibiting the following characteristics: Hc = 850 Oe, $\sigma_s$ = 132.5 emu/g, $\sigma_R/\sigma_S$ = 0.32.

Such product, after having been kept in the air for 30 days, exhibited a reduction of the $\sigma_s$ value equal to 11%.

EXAMPLE 3

6.12 g of $\alpha$-$Fe_2O_3$, having an average longitudinal dimension of 0.63$\mu$ and an average transverse dimension of 0.08$\mu$, were added with 50 cc of absolute ethyl alcohol and, keeping the mass under stirring, with 0.8 cc of $Ti[(CH_3)_2CHO]_4$ alcoholic solution (solution containing about 27 g/l of $TiO_2$). The whole was then evaporated to dryness in a furnace at 100° C and subjected to heat treatment in air for 2 hours at 500° C. The iron compound contained now 0.9% by weight of Ti, expressed as $TiO_2$, with respect to pure iron.

0.5 g of the so treated iron oxide, reduced for 5 hours with $H_2$ at 360° C, yielded a product in the form of particles having an average length of 0.6$\mu$ and an average diameter of 0.21$\mu$, exhibiting the following characteristics:

Hc = 520 Oe, $\sigma_s$ = 168.30 emu/g, $\sigma_R/\sigma_S$= 0.63.

After a 30-day permanence in the air, the $\sigma_s$ value was reduced by 3.5%.

EXAMPLE 4

10.83 g of the same $\alpha$-FeOOH of Example 1 were suspended in water. 4.4 cc of a $Na_2SiO_3$ solution containing 31.04 g/l of $SiO_2$ and so much HCl as to bring the pH value to 6 were admixed therewith. The resulting mixture was stirred at 50° C for 30 minutes, then filtered and the residue washed. It was dried during the heat treatment at 500° C for 2 hours in air. The sample obtained contained 1.9% by weight of Si, expressed as $SiO_2$, with respect to pure iron.

0.5 g of the so treated iron compound were subjected to reduction in $H_2$ at 370° C for 13 hours and provided a product in the form of particles having an average length of 0.3$\mu$ and an average diameter of 0.18$\mu$, and exhibiting the following characteristics: Hc = 586 Oe, $\sigma_s$ = 172 emu/g, $\sigma_R/\sigma_S$ = 0.33.

The product, after a 30-day permanence in the air, exhibited a reduction in the $\sigma_s$ value of 10%.

EXAMPLE 5

19.45 g of $\alpha$-FeOOH like that of Example 1 were suspended in 100 cc of water, thus obtaining a fluid mass to which 51.5 cc of a $SnCl_2 . 2H_2O$ solution acidified by HCl (0.1 M) were admixed. After addition of ammonia until the pH value was brought to 4, the mass was kept at 50° C for 30 minutes, filtered, washed by decantation and dried in a furnace at 100° C for 2 hours. 17.51 g of the iron compound so treated were imbibed with 60.5 cc of cobalt acetate (solution containing 10.12 g/l of cobalt). The mass was made pasty by heating to 50° C under stirring, after which it was then dried in a furnace at 100° C and heat-treated in air at 500° C for 2 hours. 9.43 g of the iron compound thus treated were added with 4.23 cc of a $Na_2SiO_3$ solution (31.04 g/l of $SiO_2$) and with $HNO_3$ until the pH value was brought to 6. After having kept the mass for 30 minutes at 50° C, it was filtered, washed by decantation and dried in a furnace at 100° C for 2 hours.

0.5 g of the iron compound so treated (and which contained 5% by weight of Sn, 5% by weight of Co, and 2% by weight of $SiO_2$ with respect to pure iron) were reduced with $H_2$ at 377° C for 7 hours, thus obtaining a powder having the following characteristics: average length 0.3 – 0.8$\mu$, average diameter 0.1 – 0.4$\mu$, Hc = 880 Oe, $\sigma_s$ = 163 emu/g, $\sigma_R/\sigma_S$ = 0.6.

After 30 days such powder exhibited a reduction of the $\sigma_s$ value equal to 7.3%.

EXAMPLE 6

34.41 g of $\alpha$-FeOOH like that of Example 1 were suspended in $H_2O$ and, under stirring, 91 cc of a $SnCL_2.2H_2O$ solution acidified by HCl (0.1 M) were admixed therewith. The pH value was brought to 4.5 and the mixture was kept at 45° C for 30 minutes, then it was filtered, the residue thus obtained was washed by decantation and dried in a furnace at 100° C. 6.84 g of the resulting produce were suspended in 120cc of ethyl alcohol and, under stirring, 1 cc of an alcoholic solution of Ti $[CH_3)_2CHO]_4$, containing about 27 g/l of Ti as $TiO_2$, was added. The whole was kept at 60° C, under stirring, until a pasty mass was obtained that was subsequently dried in a furnace at 120° C and subjected to heat treatment in air at 500° C for 2 hours. The sample now contained 4.6% by weight of Sn and 0.7% by weight of Ti, calculated as $TiO_2$, with respect to pure iron.

0.5 g of the iron compound so treated yielded, after 7 hours reduction in $H_2$ at 370° C, an alloy in powder form exhibiting the following characteristics: average length = 0.30μ, average diameter = 0.08μ, Hc = 728 Oe, $\sigma_s$ = 158 emu/g, $\sigma_R/\sigma_S$ = 0.46.

After 30 days the same powder exhibited the following values: Hc = 750 Oe and $\sigma_s$ = 154.8 emu/g, the decrease of the $\sigma_s$ value corresponding to 2.02%.

EXAMPLE 7

16.06 g of the iron compound containing 4.6% by weight of Sn as in the preceding example were added with 18.8 cc of a $Co(CH_3COO)_2$ solution containing 26.9 g/l of Co and so much water as to form a liquid portion, which was kept under stirring and heating at 80° C until it became pasty.

The mass was then dried in a furnace at 110° C and successively brought to 510° C in air for 2 hours.

The whole recovered sample (15.6 g) was silicized following the same procedure as described in Example 4, using 6.3 cc of a solution of $Na_2SiO_3$ (31.04 g/l of $SiO_2$) and sufficient HCl to bring the pH value to 6. It was filtered, washed and dried at 100° C.

8.38 g of the resulting product were added with titanium according to the same procedure as described in Example 3, using 1.3 cc of the same Ti $[(CH_3)_2CHO]_4$ solution in an alcoholic solution. After drying at 80° C, the product was brought to 500° C and kept at such temperature in air for 2 hours.

9.5 of the iron compound so treated (now containing 4.6% by weight of Sn, 4.8% by weight of Co, 1.9% by weight of $SiO_2$ and 0.7% by weight of $TiO_2$ with respect to pure iron) were subjected to reduction in $H_2$ at 375° C for 6 hours.

The resulting powder had particles exhibiting the following characteristics: average length = 0.82ν, average diameter = 0.27μ, Hc = 880 Oe, $\sigma_s$ = 169.8 emu/g, $\sigma_R/\sigma_S$ = 0.70.

After 30 days the following values were determined: Hc = 885 Oe and $\sigma_s$ = 166.2 emu/g, the reduction of the $\sigma_s$ value being only 2.12%.

EXAMPLE 8

12 g of the same α-FeOOH as used in Example 1 were added with 5% by weight of Co (percentage calculated with respect to pure iron) according to the procedure described in Example 5, followed by a heat treatment at 500° C in air for 2 hours.

Subsequently 5% of Sn (percentage calculated with respect to pure iron) was introduced according to the same procedure as described in Exammple 5.

3.2 g of the iron compound thus treated were suspended in ethyl alcohol and then added with an alcoholic solution of $Ti[(CH_3)_2CHO]_4$ in such amount as to introduce 1% by weight of $TiO_2$, referred to pure iron.

After a 2-hour final heat treatment in air at 450° C, 0.5 g of the thus treated iron compound were subjected to reduction of $H_2$ at 380° C for 6 hours.

The powder thus obtained exhibited the following characteristics: average length = 0.4μ, average diameter 0.07μ, Hc = 700 Oe, $\sigma_s$ = 162 emu/g, $\sigma_R/\sigma_S$ = 0.6.

After 30 days the same powder exhibited a decrease in the $\sigma_s$ value equal to 2.5%.

What is claimed is:

1. A process for preparing metallic powders based on iron and suitable for magnetic recording, starting from acicular particles of an iron compound selected from the class consisting of α-$Fe_2O_3$, α-FeOOOH, and $Fe_3O_4$, comprising the sequential steps of (a) adding to the said acicular particles of the iron compound titanium, in the form of $TiO(OH)_2$ or $TiO_2$, and tin, in the form of $Sn(OH)_2$ or $SnO(OH)_2$; (b) thereafter subjecting same to at least one treatment in air at 400°–550° C,; and finally (c) subjecting the mixture to reductionat 340°–420° C with a gas containing more than 50% by volume of hydrogen; the titanium being introduced into the particles of the iron compound in an amount of 0.5 – 1% by weight, calculated as $TiO_2$, and the tin being introduced in an amount of 3 – 6% by weight, these percentages being referred to pure iron.

2. A process according to claim 1, wherein the titanium is introduced by:

preparing a suspension of α-$Fe_2O_3$, α-FeOOH or $Fe_3O_4$ in ethyl alcohol;

adding an alcoholic solution of $TiCl_4$l in an amount varying according to the amount of titanium to be introduced;

precipitating $TiO(OH)_2$, at a temperature ranging from room temperature to 60° C, by the addition of water; and filtering, washing and drying the resulting mass.

3. A process according to claim 1, wherein the titanium is introduced by:

preparing a fluid paste of α-$Fe_2O_3$, α-FeOOH or $Fe_3O_4$ in ethyl alcohol;

adding a titanium organic salt in alcoholic solution, in an amount varying according to the percentage of titanium to be introduced;

impregnating the iron compound with the titanium organic salt at a temperature ranging from room temperature to 60° C; and drying the mass so obtained.

4. A process according to claim 1, wherein the tin is introduced by:

preparing a suspension of α-$Fe_2O_3$, α-FeOOH or $Fe_3O_4$ in water;

adding an acid solution of a tin salt in an amount varying according to the percentage of tin to be introduced;

precipitating $Sn(OH)_2$ or $SnO(OH)_2$ at a temperature between room temperature and 60° C, bringing the pH to a value ranging from 3 to 5 by the addition of $NH_4OH$ or NaOH; and filtering, washing and drying the thus-obtained mass.

5. A process according to claim 1, wherein in step (a) the acicular particles of the iron compound are treated not only with titanium and tin, but also with cobalt and/or silica; the cobalt being introduced into the particles of iron compound in an amount not exceeding 6% by weight with respect to pure iron, and the silica being introduced into the particles of iron compound in an amount not exceeding 5% by weight with respect to pure iron.

6. A process according to claim 5, wherein the cobalt is introduced by:

preparing a fluid paste of α-$Fe_2O_3$, αFeOOH or $Fe_3O_4$ in water;

adding a cobalt acetate solution in an amount varying according to the percentage of cobalt to be introduced;

heating the mass to 50°-80° C, under stirring, until it becomes pasty; and drying the mass thus obtained.

7. A process according to claim 5, wherein the silica is introduced by:

preparing a suspension of $\alpha$-$Fe_2O_3$, $\alpha$-FeOOH or $Fe_3O_4$ in water;

adding an aqueous solution of $Na_2SiO_3$ in an amount varying according to the percentage of $SiO_2$ to be introduced;

precipitating $SiO_2$ at a temperature ranging from room temperature to 60° C, bringing the pH to a value not exceeding 6 by addition of HCl or $HNO_3$; and filtering, washing and drying the mass thus obtained.

8. A process according to claim 1, wherein the tin is introduced prior to the introduction of the titanium.

9. Metallic powders based on iron suitable for magnetic recording, when prepared by a process according to claim 1.

* * * * *